US009149680B2

(12) United States Patent
Thompson et al.

(10) Patent No.: US 9,149,680 B2
(45) Date of Patent: Oct. 6, 2015

(54) KETTLEBELL CONVERTER

(76) Inventors: Paul Thompson, Greenville, SC (US); Ryan Hoag, Simpsonville, SC (US)

( * ) Notice: Subject to any disclaimer, the term of this patent is extended or adjusted under 35 U.S.C. 154(b) by 366 days.

(21) Appl. No.: 13/564,860

(22) Filed: Aug. 2, 2012

(65) Prior Publication Data

US 2013/0210589 A1 Aug. 15, 2013

Related U.S. Application Data

(60) Provisional application No. 61/514,104, filed on Aug. 2, 2011.

(51) Int. Cl.
*A63B 21/072* (2006.01)
*A63B 21/075* (2006.01)
*A63B 21/00* (2006.01)

(52) U.S. Cl.
CPC ..... *A63B 21/072* (2013.01); *A63B 21/0726* (2013.01); *A63B 21/1469* (2013.01)

(58) Field of Classification Search
CPC ..... A63B 21/072; A63B 21/0726; A63B 21/0608; A63B 21/1469
USPC ..... 482/44, 49–50, 92–93, 106–109, 908; 269/3, 6, 71, 75, 95; 294/15, 16, 137, 294/162, 165, 167; 16/422, 426
See application file for complete search history.

(56) References Cited

U.S. PATENT DOCUMENTS

| | | | | |
|---|---|---|---|---|
| 7,883,452 | B1 * | 2/2011 | Chen | 482/93 |
| 8,267,841 | B1 * | 9/2012 | Allison et al. | 482/108 |
| 8,684,889 | B1 * | 4/2014 | Berrisford | 482/49 |
| 2011/0111929 | A1 * | 5/2011 | Allison et al. | 482/108 |
| 2011/0173778 | A1 * | 7/2011 | Wales | 16/426 |
| 2012/0252641 | A1 * | 10/2012 | Odneal et al. | 482/108 |

* cited by examiner

*Primary Examiner* — Oren Ginsberg
*Assistant Examiner* — Joshua Lee
(74) *Attorney, Agent, or Firm* — Nelson Mullins Riley & Scarborough LLP

(57) ABSTRACT

The present invention relates to an apparatus for converting a free weight into a kettlebell weight. The apparatus includes a main body housing, a rotatable handle, and a pivot grip. The apparatus may move from an open position for receiving a free weight to a closed position for locking a free weight into place.

20 Claims, 7 Drawing Sheets

FIG. –1–

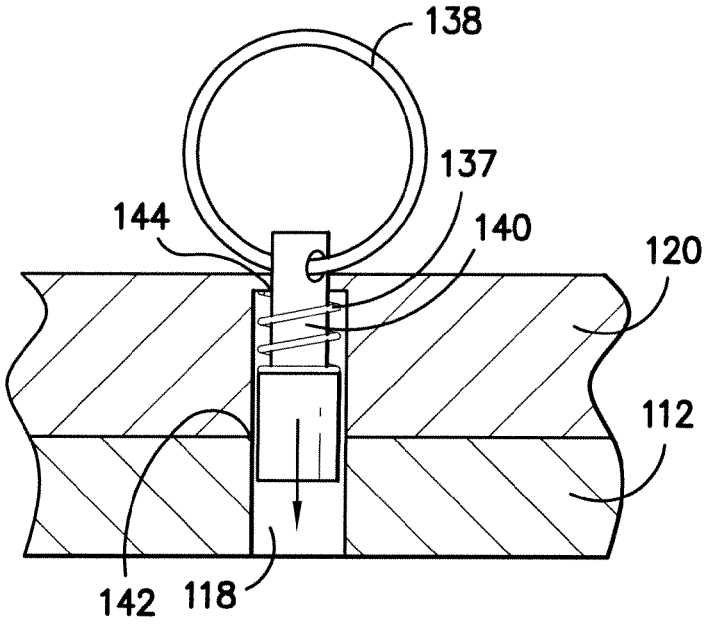
FIG. –4A–
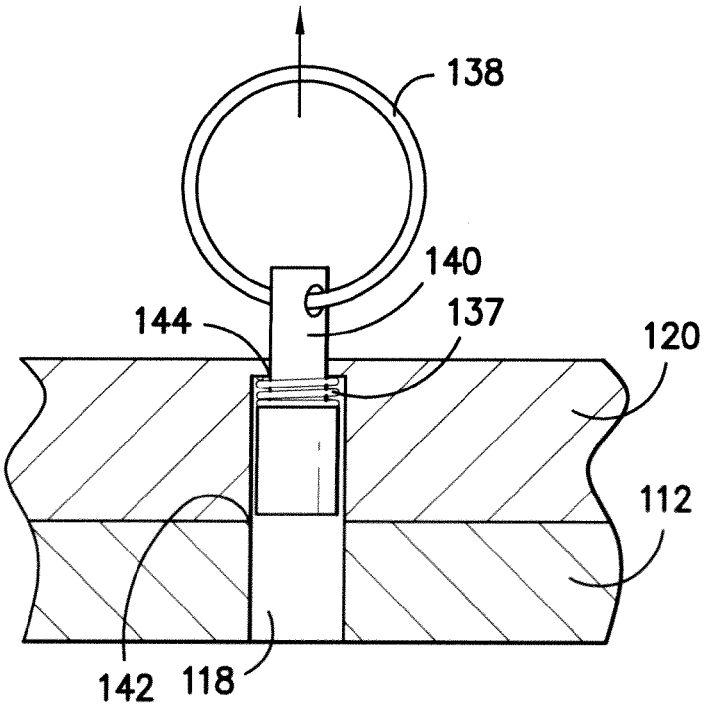
FIG. –4B–

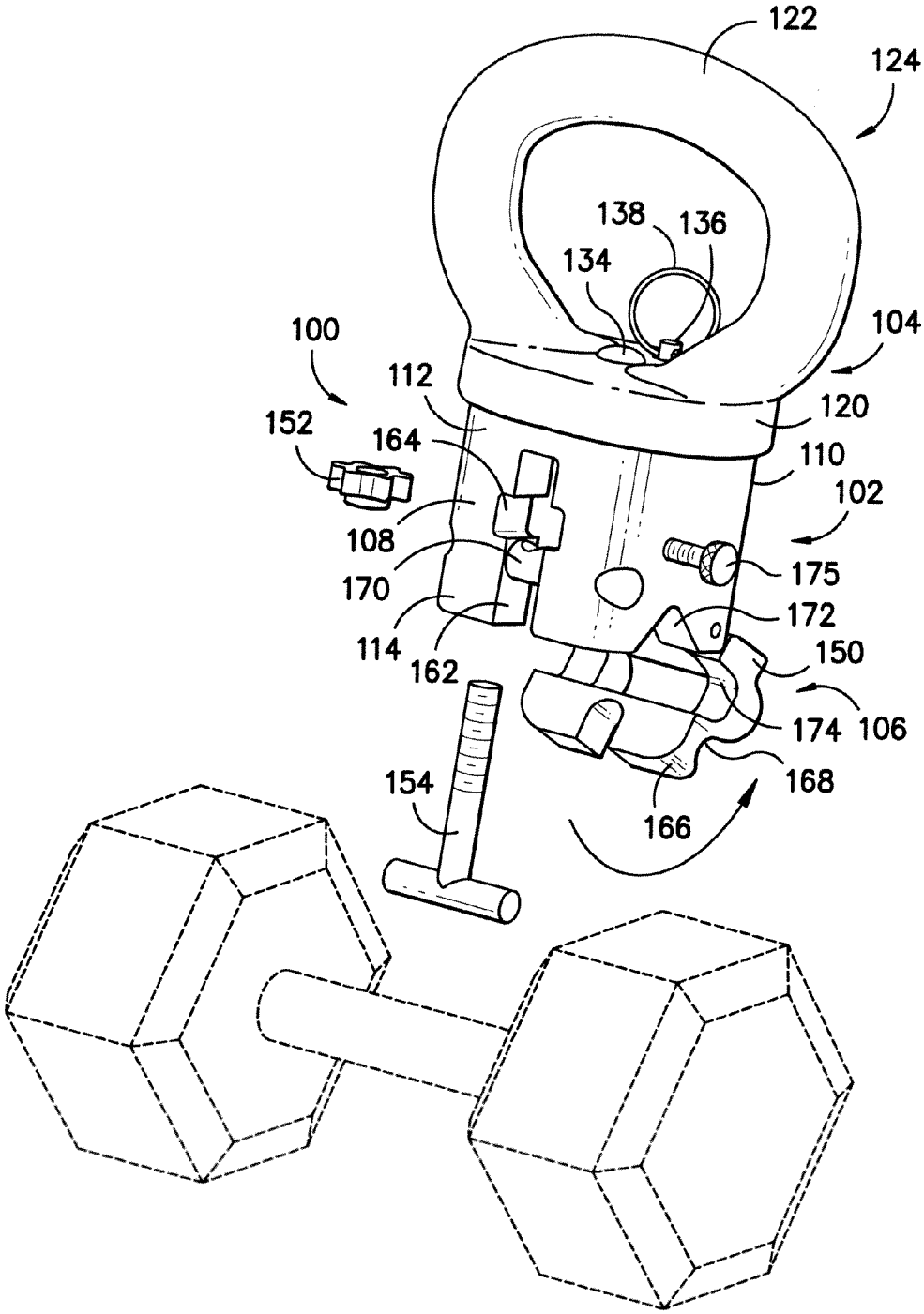
FIG. –5–

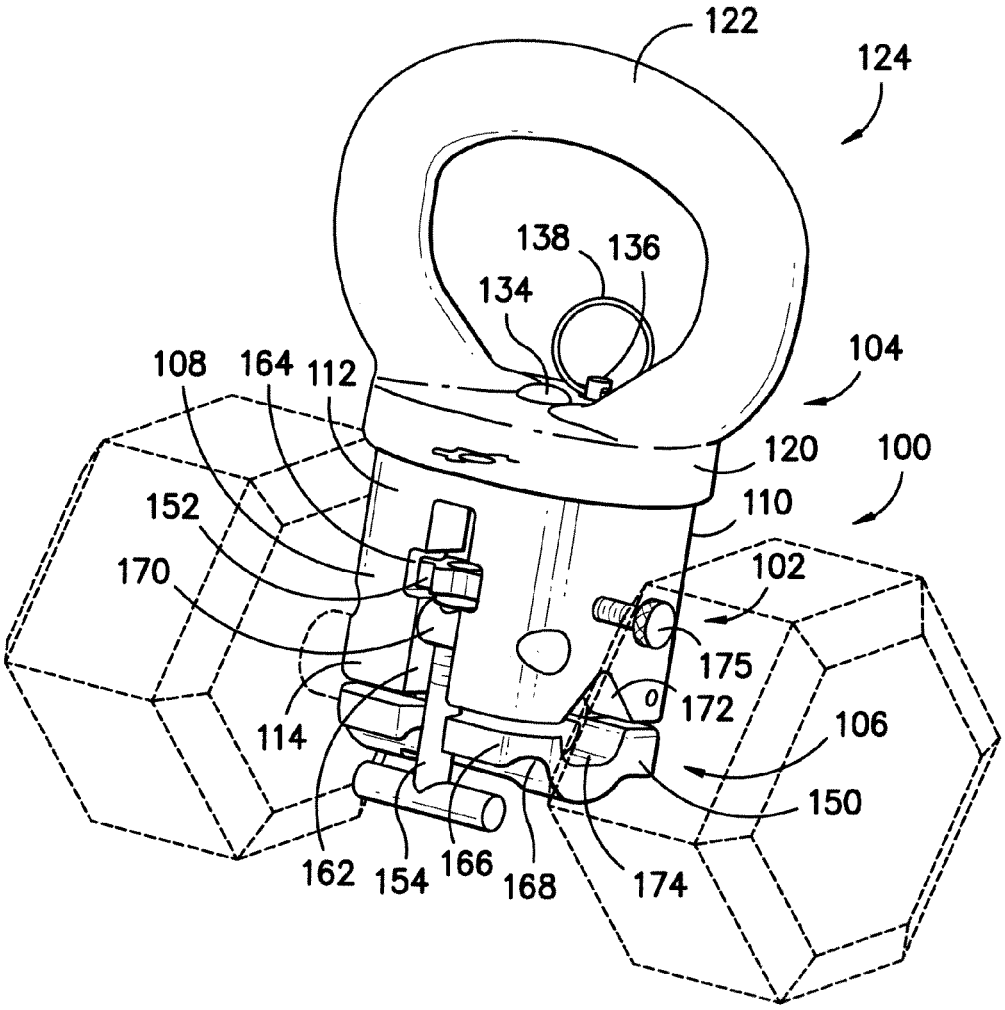
*FIG. –6–*

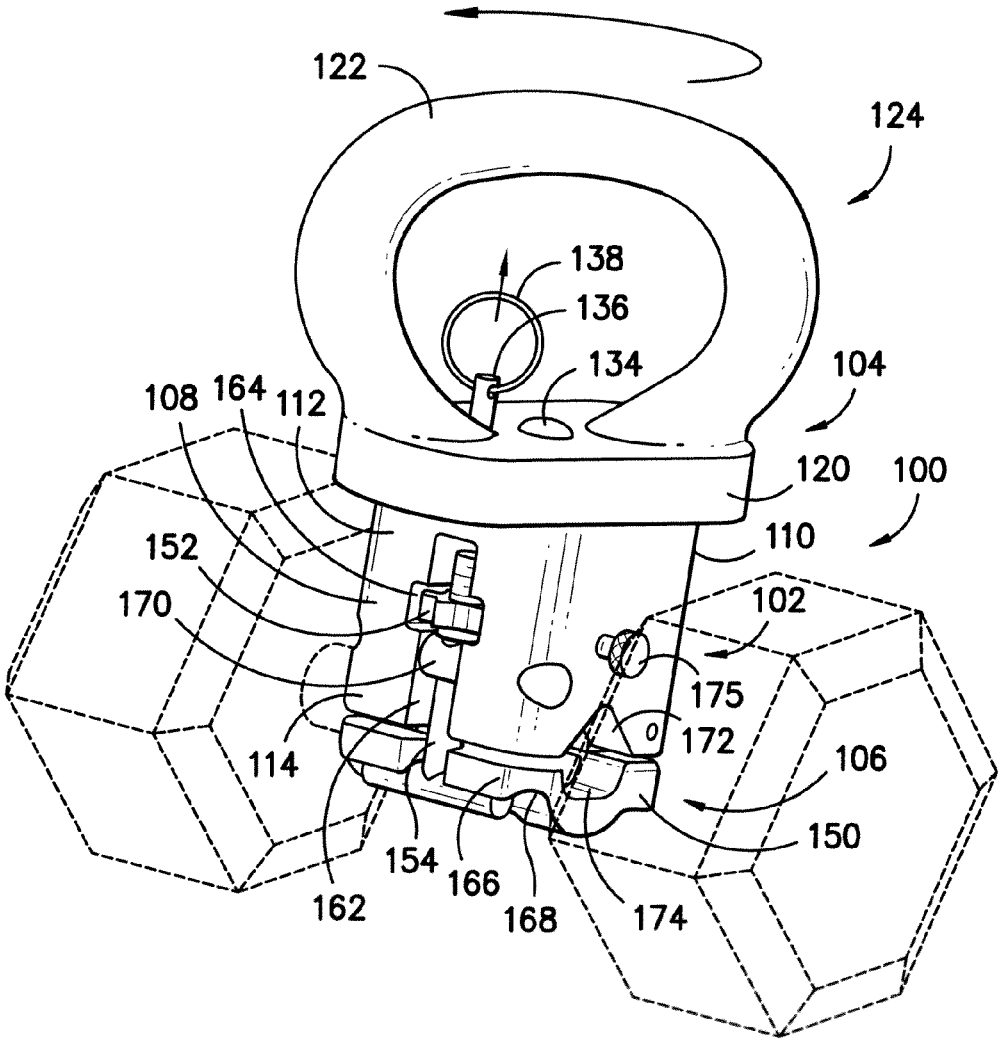
*FIG. –7–*

KETTLEBELL CONVERTER

CROSS-REFERENCE TO RELATED APPLICATIONS

This applications claims the benefit under 35 U.S.C. §119 (e) of U.S. Provisional Application No. 61/514,104 filed Aug. 2, 2011, the entirety of which is hereby incorporated by reference.

FIELD OF THE INVENTION

The present invention relates generally to an apparatus that converts traditional handheld free weights to kettlebell weights.

BACKGROUND OF THE INVENTION

Kettlebells have traditionally included a cast iron weight shaped as a cylinder with a suitcase style handle attached thereto. Kettlebells have gained recent notoriety and have been used to improve weight training for the entire body, producing a high degree of strength training as well as an aerobic activity.

SUMMARY OF THE INVENTION

According to an aspect, the present invention provides an apparatus for converting a free weight to a kettlebell weight. The apparatus includes a main body housing with a top end and an opposite bottom end, a front end and an opposite back end, a lock bolt recess located on the main body housing front end and extending between the main body housing bottom end and the main body housing top end, and a lock collar recess located on the main body housing front end and extending perpendicular to the lock body recess. The apparatus further includes a rotatable handle located on the main body housing top end, a pivot grip comprising a front end and a back end, where the pivot grip front end is pivotally connected to the main body housing back end, a lock bolt comprising a top threaded end and a bottom end including a stopper and wherein the lock bolt is selectively received in the lock bolt recess, and a lock collar including a threaded inner portion and wherein the lock collar is selectively received in the lock collar recess. The apparatus may move between an open position, where the pivot grip front end is away from the main body housing front end, and a closed position, where the pivot grip front end is adjacent the main body housing front end. In addition, when the apparatus is in the closed position, the lock bolt is received in the lock bolt recess, the lock collar is received in the lock collar recess and the lock collar threaded inner portion receives the lock bolt top threaded end until the lock bolt second end stopper abuts the pivot grip front end.

According to another aspect, the present invention is directed to an apparatus for converting a free weight to a kettlebell weight. The apparatus includes a main body housing with a top end and an opposite bottom end, a front end and an opposite back end, a stationary bore located in a center portion of main body housing top end, and at least two rotational bores located on the main body housing top end that are each located at a substantially equal distance from the threaded stationary bore. The apparatus further includes a pivot grip comprising a front end and a back end, where the pivot grip front end is pivotally connected to the main body housing back end. The apparatus also includes a rotatable handle located on the main body housing top end and with a bottom end and an opposite top end, a rotatable handle stationary bore aligned with the stationary bore of the main body housing and a locking bore aligned with one of the at least two rotational bores. The apparatus also includes a locking pin received in the locking bore comprising a bottom end that selectively extends into the aligned rotational bore and a top end comprising a tab and a rod with a bottom end stationarily positioned within main body housing stationary bore and extending through rotatable handle stationary bore and a top end comprising an end cap that restricts movement of rotatable handle away from main body housing. The rotatable handle is adapted to be rotated about the main body housing by selectively disengaging the locking pin from the aligned rotational bore and rotating rotatable handle until locking pin may be engaged in a different rotational bore.

The drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which:

FIG. 4A is a cross-sectional side view of a locking bore and a rotational bore of the kettlebell converter of FIG. 1;

FIG. 4B is a cross-sectional side view of a locking bore and a rotational bore of the kettlebell converter of FIG. 1;

FIG. 5 is a side perspective view of the kettlebell converter of FIG. 1 where the kettlebell converter is in the open position;

FIG. 6 is a side perspective view of the kettlebell converter of FIG. 1 where the kettlebell converter is being moved to the closed position; and FIG. 7 is a side perspective view of the kettlebell converter of FIG. 1 where the kettlebell converter is in the closed position.

Figure 1:
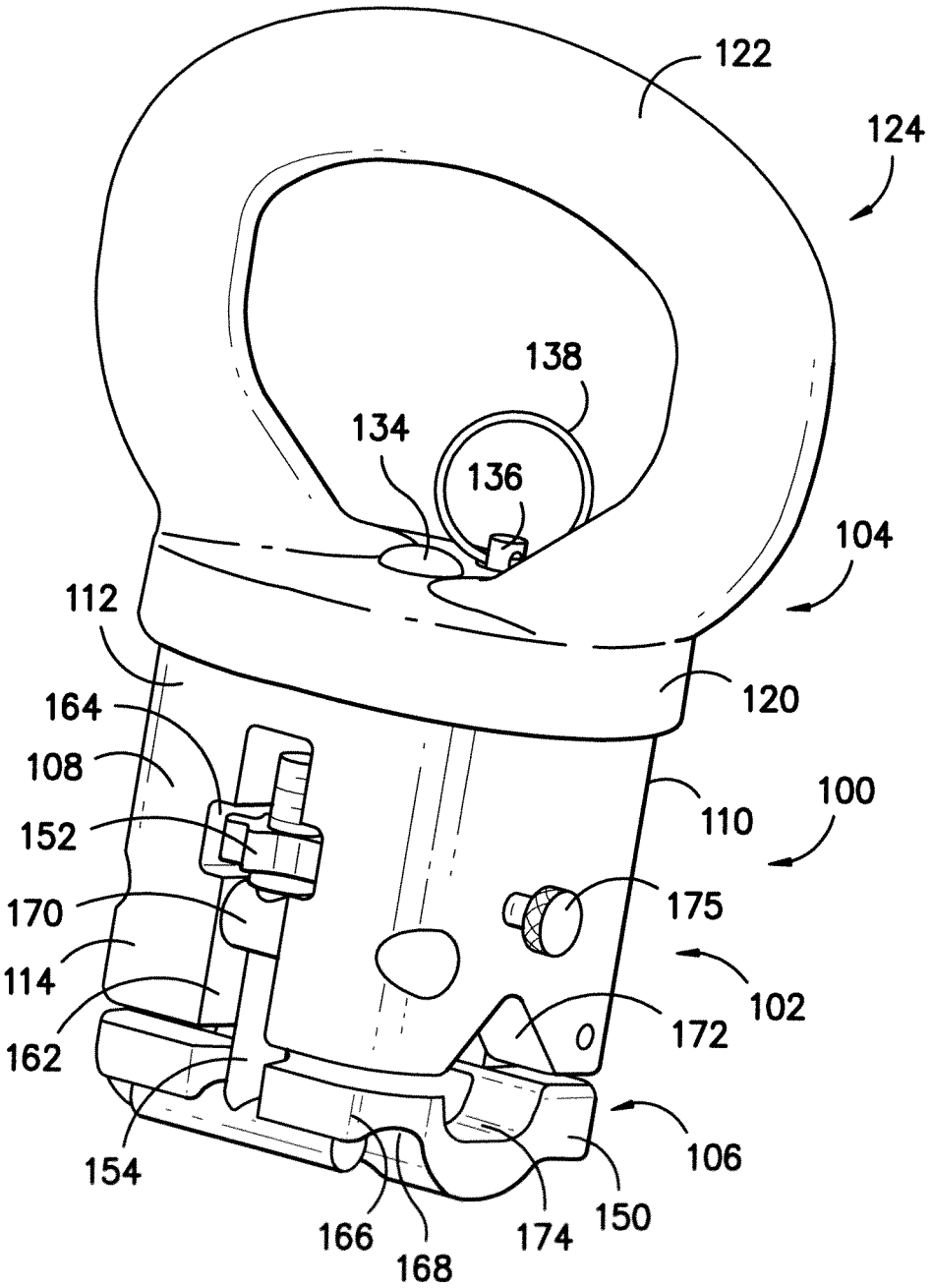
FIG. 1 is a perspective view of a kettlebell converter in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
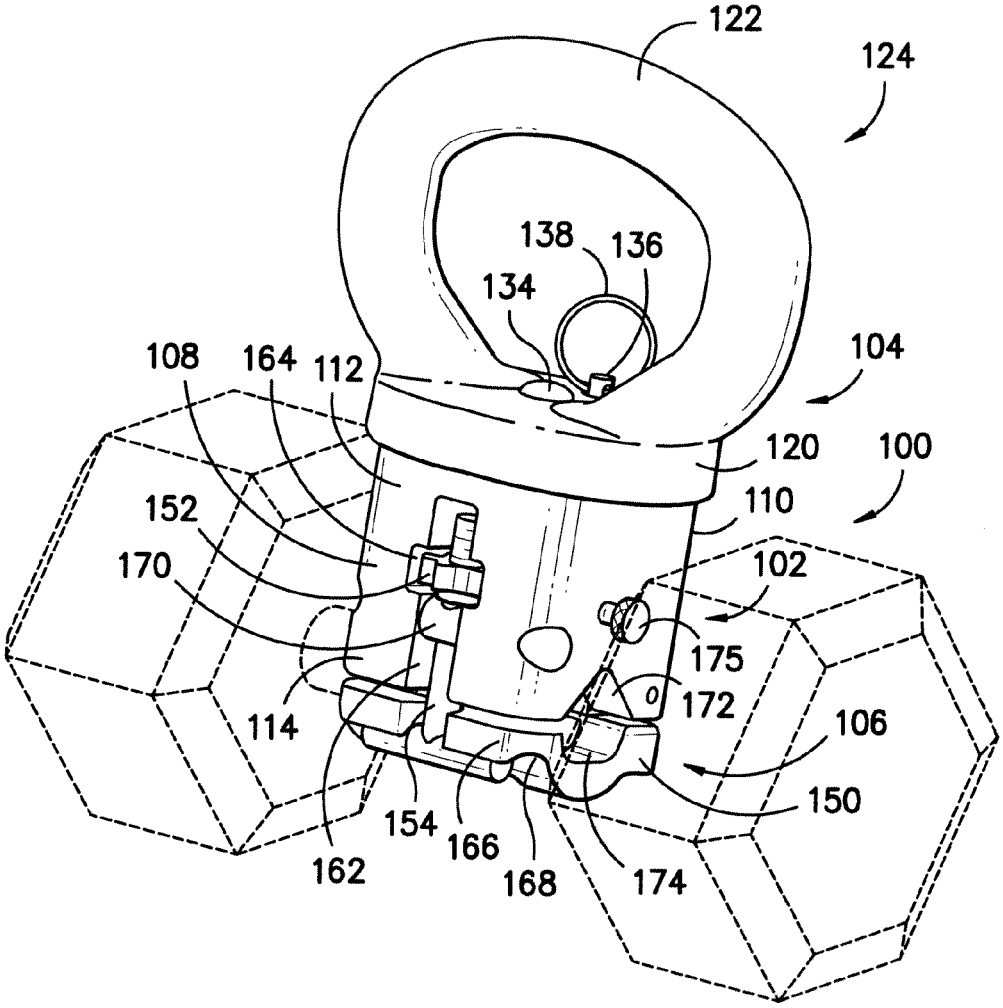
FIG. 2 is a perspective view of the kettlebell converter of FIG. 1 where the kettlebell converter is holding a transparent handheld free weight.
Figure 3:
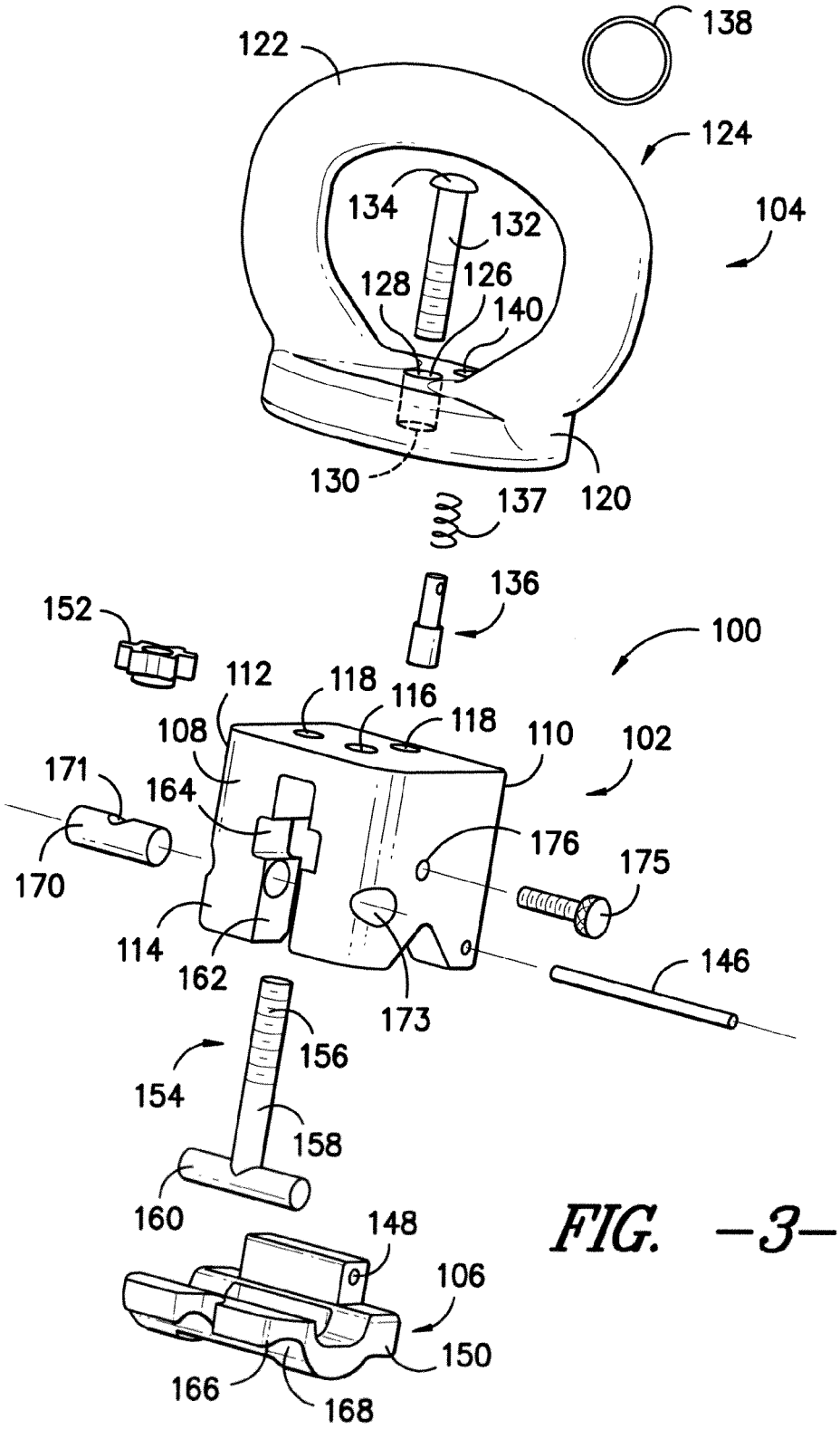
FIG. 3 is an exploded perspective view of the kettlebell converter of FIG. 1.

A kettlebell converter 100 in accordance with an embodiment of the present invention is shown in the Figures. As shown in FIGS. 1 to 3, kettlebell converter 100 includes main body housing 102, a rotatable handle 104, and a pivot grip 106. Utilizing the components of the present invention, a standard handheld free weight may be transformed into a kettlebell weight as shown in FIG. 2. Providing such transformation allows for added functionality of standard handheld free weights as they may now, with the use of the present invention, be used to perform movements and maneuvers that are unique to kettlebell weights. In addition, a single embodiment of the present invention may be used with handheld free weights of varying weights, thereby providing a variety of kettlebell weights to match the particular user's strength levels.

As indicated above, and as shown in FIGS. 1-3, kettlebell converter 100 includes main body housing 102. Main body housing 102 includes a front end 108, an opposite back end 110, a top end 112 that makes contact with rotatable handle 104 and an opposite bottom end 114 in which pivot grip 106 is pivotally connected. As more fully explained below, kettlebell converter 100 may move from an open position for receiving a handheld free weight (FIG. 5) to a closed position where a hand held free weight may be locked within kettlebell converter (FIGS. 2 and 7).

As more clearly shown in FIG. 3, main body housing top end 112 includes a plurality of bores. Such bores allow for rotatable handle 104 to rotate about main body housing 102 as more fully explained below. Main body housing top end 112 includes a threaded stationary bore 116 that may be located in a center portion of main body housing top end 112, and at least two rotational bores 118 that are spaced outside of, and about equal distance from, threaded stationary bore 116. As shown in FIG. 3, rotational bores 118 are spaced about 90° from one another. Such spacing may allow for the desired movement of rotatable handle 104 as discussed below.

As indicated above, rotatable handle 104 makes contact with main body housing top end 112 and may rotate as desired by the user. Rotatable handle 104 includes a bottom end 120 that makes contact with main body housing top end 112 and a top end 122 that forms a handle portion 124. Rotatable handle bottom end 120 includes a stationary bore 126, with a top end 128 and a bottom end 130, which receives a threaded rod 132 with an end cap 134, where the diameter of the end cap 134 is greater than that of rotatable handle stationary bore 126. When threaded rod 132 is placed through rotatable handle stationary bore 126 it extends beyond rotatable handle stationary bore bottom end 130 and is mated with threaded stationary bore 116 of main body housing 102. During such process, end cap 134 is situated proximate stationary bore top end 128. The mating of threaded rod 132 with threaded stationary bore 116 and the placement of end cap 134 restricts upward movement of rotatable handle 104 away from main body housing 102. In addition, the absence of threads within rotatable handle stationary bore 126 allows for rotatable handle 104 to rotate 360° about main body housing 102 when threaded rod 132 is mated with threaded stationary bore 116 of main body housing 102. It should be noted that in additional embodiments of the present invention, rotatable handle stationary bore 126 may be threaded while threaded rod 132 may be unthreaded along a portion of threaded rod 132 that is situated within rotatable handle stationary bore 116. Such configuration may still allow rotatable handle 104 to rotate about main body housing 102. The particular configuration utilized may be based on the user's specifications.

Rotatable handle bottom end 120 further includes a locking pin 136 that is biased by a spring 137 and is actuated by a release ring 138. Locking pin 136 is situated within a locking bore 140 that includes a bottom end 142 that makes contact with main body housing 102 and a top end 144 proximate release ring 138, as shown in FIGS. 4A and 4B. In its natural position, locking pin 136 extends beyond locking bore bottom end 142 and is mated with a rotational bore 118 of main body housing 102 (FIG. 4A). Such position locks or restricts rotatable movement of rotatable handle 104 about main body housing 102. Actuation of release ring 138 in an upward direction moves locking pin 136 out of rotational bore 118 (FIG. 4B) such that rotation of rotatable handle 104 is permitted, allowing a user to rotate rotatable handle 104 to the desired position that corresponds to the placement of a rotational bore 118. Once the position is reached, locking pin 136, with force from the spring, will extend into the corresponding rotational bore 118, thereby restricting further rotatable movement of rotatable handle 104.

As indicated above, rotatable handle top end 122 forms a handle portion 124. Any type of handle shape or size may be utilized to meet the specifications of the user. For example, in some embodiments and as shown in the Figures, handle portion 124 may be in the form of a suitcase style handle. In additional embodiments, handle portion 124 may be in the form of a ring or other polygonal shape.

As indicated above, main body housing bottom end 114 is pivotally connected to pivot grip 106 to allow kettlebell converter 100 to move from an open position to a closed position. In the open position, pivot grip 106 is away from main body housing 102 and allows access to main body housing bottom end 114, whereas in the closed position, pivot grip 106 abuts main body housing bottom end 114. To form such connection, main body housing 102, on its bottom end 114 proximate its back end 110, includes a horizontal pivot pin 146 that may be mated with a horizontal bore 148 of a back end 150 of pivot grip 106. Such connection allows for pivot grip 106 to swing between the open and closed positions as shown in FIGS. 5 through 7.

When kettlebell converter 100 is in a closed position, pivot grip 106 should be locked into position such that it may maintain the weight of a handheld free weight. In embodiments of the present invention, maintaining the closed position may be accomplished by a lock collar 152 mated with a lock bolt 154 positioned between main body housing 102 and pivot grip 106. Lock collar 152 of the present invention may be a toothed ring with a threaded inner circumference and threaded lock bolt 154 includes a top threaded end 156 and a bottom end 158 that includes a stopper 160 that may be formed as a horizontal bar.

As shown in the Figures, main body housing 102 includes a lock bolt recess 162 and a lock collar recess 164 on its front end 108 to receive lock bolt 154 and lock collar 152, respectively. Lock bolt recess 162 extends from main body housing bottom end 114 in the direction of main body housing top end 112 and lock collar recess 164 passes through lock bolt recess 162 in a perpendicular manner. In addition, pivot grip 106 includes, on a front end 166, a horizontal lock bolt indention 168 for receiving lock bolt bottom end 158. In some embodiments of the present invention, main body housing 102 may further include a secure pin 170 with a hole 171 selectively received in a secure pin bore 173. Secure pin bore 173 may be located perpendicular to lock bolt recess 162 and secure pin 170 may be positioned such that lock bolt 154 is received through secure pin hole 171 thereby restricting lock bolt 154 from moving in a forward direction when lock bolt 154 is received in lock bolt recess 162. In additional embodiments of the present invention, main body housing 102 may include a lock bar 175 selectively received in a lock bar bore 176. Lock bar bore 176 is located adjacent lock collar recess 164 and, when lock bar 175 is fully received within lock bar bore 176, lock bar 175 engages a tooth of lock collar 152.

As indicated above and as shown in FIGS. 2 and 7, when kettlebell converter 100 is in a closed position, it may be utilized to lock a handheld free weight between main body housing bottom end 114 and pivot grip 106. To aid in fitting such free weights within kettlebell converter 100, main body housing bottom end 114 and pivot grip 106 may each include converse depressions 172, 174 for receiving the handle portion of a standard handheld free weight. Although in the illustrated embodiment both main body housing bottom end 114 and pivot grip 106 each include depressions 172, 174, in additional embodiments of the invention, either main body housing bottom end 114 alone, or pivot grip 106 alone, may include such depression. The user's specifications may dictate the particular embodiment utilized.

In operation, as indicated above, kettlebell converter 100 may move from an open position to receive a handheld free weight to a closed position, where a handheld free weight is locked within kettlebell converter 100. Starting from the open position, the handle portion of a free weight is placed adjacent to main body housing depression 172 and pivot grip 106 is swung to the closed position until pivot grip depression 174 is also adjacent to the handle portion of the free weight. Lock collar 152 and lock bolt 154 are then received in lock collar recess 164 and lock bolt recess 162, respectively, whereby lock bolt 154 is further received through secure pin hole 171. In such a position, lock bolt threaded top end 156 is mated with the threaded interior circumference of lock collar 152. Lock collar 152 is then rotated, forcing lock bolt 154 in the direction of main body housing top end 112, until lock bolt stopper 160 is securely flush with horizontal lock bolt indention 168, thereby locking handheld free weight within kettlebell converter 100. In some embodiments, and as discussed above, lock bar 175 may be received within lock bar bore 176 until lock bar lockingly engages a tooth of lock collar 152, thereby restricting movement of lock collar 152. The movement of kettlebell converter 100 from open position to closed position is illustrated in FIGS. 5 through 7.

As indicated above, once kettlebell converter 100 is in a closed position, a user may wish to rotate rotatable handle 104 (FIG. 7) to provide a kettlebell weight in various orientations. Accordingly, a user may apply upward force to release ring 138 and rotate rotatable handle 104 about main body housing 102 until the desired orientation of rotatable handle 104 is reached. Once the position is reached and it corresponds to an available main body housing rotational bore 118, the user will remove the upward force from release ring 138 and locking pin 136, with force from the spring, will extend into the corresponding rotational bore 118, thereby restricting further rotatable movement of rotatable handle 104.

To return kettlebell converter 100 to the closed position, lock bar 175 is rotated to disengage a tooth of lock collar 152 and lock collar 152 is rotated in an opposite direction forcing lock bolt 154 away from main body housing top end 112 and releasing the secured connection of stopper 160 to horizontal lock bolt indention 168. After lock collar 152 is sufficiently rotated to release lock bolt threaded top end 156, pivot grip 106 is free to swing away from main body housing 102, allowing the user to remove the handheld free weight.

As indicated above, the present invention allows a user to transform a standard handheld free weight into a kettlebell weight. Providing such transformation allows for added functionality of standard handheld free weights as they may now, with the use of the present invention, be used to perform movements and maneuvers that are unique to kettlebell weights. Due to the recent popularity of kettlebell weights and the general widespread availability of standard handheld free weights, the present invention allows for the availability of kettlebell weights to users while still providing cost savings.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the versions contained therein.

What is claimed is:

1. An apparatus for converting a free weight to a kettlebell weight, the apparatus comprising:

a main body housing comprising:

a top end and an opposite bottom end, a front end and an opposite back end, a lock bolt recess located on the main body housing front end and extending between the main body housing bottom end and the main body housing top end, and a lock collar recess located on the main body housing front end and extending perpendicular to the lock bolt recess;

a rotatable handle located on the main body housing top end;

a pivot grip comprising a front end and a back end, wherein the pivot grip front end is pivotally connected to the main body housing back end;

a lock bolt comprising a top threaded end and a bottom end comprising a stopper, wherein the lock bolt is selectively received in the lock bolt recess; and a lock collar comprising a threaded inner portion, wherein the lock collar is selectively received in the lock collar recess;

wherein the apparatus may move between an open position, where the pivot grip front end is away from the main body housing front end, and a closed position, where the pivot grip front end is adjacent the main body housing front end; and wherein when the apparatus is in the closed position, the lock bolt is received in the lock bolt recess, the lock collar is received in the lock collar recess, and the lock collar threaded inner portion receives the lock bolt top threaded end until the lock bolt second end stopper abuts the pivot grip front end.

2. The apparatus of claim 1, wherein the main body housing bottom end and the pivot grip include converse depressions.

3. The apparatus of claim 1, wherein the main body housing further comprises:

a secure pin bore located perpendicular to the lock bolt recess; and a secure pin with a hole that is selectively received within the secure pin bore, wherein the secure pin may be received in the secure pin bore when the apparatus is in a closed position such that the lock bolt is received through the hole of the secure pin.

4. The apparatus of claim 1, wherein the main body housing further comprises:

a lock bar bore located adjacent to the lock collar recess; and a lock bar selectively received within the lock bar bore, wherein the lock bar may be received within the lock bar bore and lockingly engage the lock collar when the apparatus is in a closed position.

5. The apparatus of claim 1, wherein the lock bolt bottom end stopper is in the shape of a "T".

6. The apparatus of claim 1, wherein the pivot grip front end further includes an indention that makes contact with the lock bolt bottom end stopper when the apparatus is in the closed position.

7. An apparatus for converting a free weight to a kettlebell weight, the apparatus comprising:

a main body housing comprising:

a top end and an opposite bottom end, a front end and an opposite back end, a threaded main body housing stationary bore located in a center portion of main body housing top end, and at least two rotational bores located on the main body housing top end that are each located at a substantially equal distance from the threaded main body housing stationary bore;

a pivot grip comprising a front end and a back end, where the pivot grip front end is pivotally connected to the main body housing back end;

a rotatable handle located on the main body housing top end and comprising:

a bottom end and an opposite top end;

a rotatable handle stationary bore aligned with the threaded main body housing stationary bore; and a locking bore aligned with one of the at least two rotational bores;

a locking pin received in the locking bore comprising a bottom end that selectively extends into the aligned rotational bore and a top end comprising a tab;

a rod with a bottom end stationarily positioned within the threaded main body housing stationary bore and extending through the rotatable handle stationary bore and a top end comprising an end cap that restricts movement of the rotatable handle away from the main body housing;

wherein the rotatable handle is adapted to be rotated about the main body housing by selectively disengaging the locking pin from the aligned rotational bore and rotating the rotatable handle until the locking pin is engaged in a different rotational bore.

8. The apparatus of claim 7, wherein the rotatable handle top end is in the shape of a suitcase style handle.

9. The apparatus of claim 7, wherein the rotatable handle top end is in the shape of a ring.

10. The apparatus of claim 7, wherein the at least two rotational bores of the main body housing are located 90° apart from one another based on the position of the threaded main body housing stationary bore.

11. The apparatus of claim 7, wherein the main body housing includes four rotational bores.

12. The apparatus of claim 7, wherein the locking pin is biased by a spring that forces engagement of the locking pin within a rotational bore.

13. An apparatus for converting a free weight to a kettlebell weight, the apparatus comprising:

a main body housing comprising:

a top end and an opposite bottom end, a front end and an opposite back end, a lock bolt recess located on the main body housing front end and extending between the main body housing bottom end and the main body housing top end, a lock collar recess located on the main body housing front end and extending perpendicular to the lock bolt recess, a threaded main body housing stationary bore located in a center portion of the main body housing top end, and at least two rotational bores located on the main body housing top end that are each located at a substantially equal distance from the threaded main body housing stationary bore;

a rotatable handle located on the main body housing top end and comprising:

a bottom end and an opposite top end;

a rotatable handle stationary bore aligned with the threaded main body housing stationary bore; and a locking bore aligned with one of the at least two rotational bores;

a locking pin received in the locking bore comprising a bottom end that selectively extends into the aligned rotational bore and a top end comprising a tab;

a rod with a bottom end stationarily positioned within the threaded main body housing stationary bore and extending through the rotatable handle stationary bore and a top end comprising an end cap that restricts movement of the rotatable handle away from the main body housing;

a pivot grip comprising a front end and a back end, wherein the pivot grip front end is pivotally connected to the main body housing back end;

a lock bolt comprising a top threaded end and a bottom end comprising a stopper, wherein the lock bolt is selectively received in the lock bolt recess; and a lock collar comprising a threaded inner portion, wherein the lock collar is selectively received in the lock collar recess;

wherein the rotatable handle is adapted to be rotated about the main body housing by selectively disengaging the locking pin from the aligned rotational bore and rotating the rotatable handle until the locking pin is engaged in a different rotational bore;

wherein the apparatus may move between an open position, where the pivot grip front end is away from the main body housing front end, and a closed position, where the pivot grip front end is adjacent the main body housing front end; and wherein when the apparatus is in the closed position, the lock bolt is received in the lock bolt recess, the lock collar is received in the lock collar recess, and the lock collar threaded inner portion receives the lock bolt top threaded end until the lock bolt second end stopper abuts the pivot grip front end.

14. The apparatus of claim 13, wherein the main body housing bottom end and the pivot grip include converse depressions.

15. The apparatus of claim 13, wherein the main body housing further comprises:

a secure pin bore located perpendicular to the lock bolt recess; and a secure pin with a hole that is selectively received within the secure pin bore, wherein the secure pin may be received in the secure pin bore when the apparatus is in a closed position such that the lock bolt is received through the hole of the secure pin.

16. The apparatus of claim 13, wherein the main body housing further comprises:

a lock bar bore located adjacent to the lock collar recess; and a lock bar selectively received within the lock bar bore, wherein the lock bar may be received within the lock bar bore and lockingly engage the lock collar when the apparatus is in a closed position.

17. The apparatus of claim 13, wherein the at least two rotational bores of the main body housing are located 90° apart from one another based on the position of the main body housing stationary bore.

18. The apparatus of claim 13, wherein the main body housing includes four rotational bores.

19. The apparatus of claim 13, wherein the locking pin is biased by a spring that forces engagement of the locking pin within a rotational bore.

20. The apparatus of claim 13, wherein the rotatable handle top end is in the shape of a ring.

* * * * *